United States Patent [19]

Carp

[11] Patent Number: 4,527,480

[45] Date of Patent: Jul. 9, 1985

[54] MEANS FOR THE DEACTIVATION OF ELECTRIC BLASTING CAPS

[75] Inventor: Gerald Carp, Potomac, Md.

[73] Assignee: The United States of America as represented by the Secretary of Transportation, Washington, D.C.

[21] Appl. No.: 283,250

[22] Filed: Jul. 14, 1981

Related U.S. Application Data

[63] Continuation-in-part of Ser. No. 947,974, Oct. 2, 1978, abandoned.

[51] Int. Cl.[3] ..... C06C 7/00

[52] U.S. Cl. ..... 102/202.1; 102/202.5

[58] Field of Search ..... 102/202.1, 202.2, 202.3, 102/202.4, 206.6, 262, 202.5; 335/25

[56] References Cited

U.S. PATENT DOCUMENTS

| | | | |
|---|---|---|---|
| 3,344,744 | 10/1967 | Bankston, Jr. | 102/202.1 |
| 3,585,933 | 7/1971 | Kos | 102/202.1 |
| 3,658,009 | 4/1972 | Allen | 102/262 |
| 3,976,012 | 8/1976 | Nordgren | 102/202.6 |

FOREIGN PATENT DOCUMENTS

| | | | |
|---|---|---|---|
| 336423 | 10/1930 | United Kingdom | 102/202.1 |

*Primary Examiner*—Stephen J. Lechert, Jr.
*Attorney, Agent, or Firm*—Otto M. Wildensteiner; Harold P. Deeley, Jr.

[57] ABSTRACT

An electric blasting cap designed to be permanently disabled by the application of an external magnetic field. The cap contains a magnetic reed switch which creates an open circuit or a short circuit to prevent current from reaching the bridge wire. One embodiment of the switch is operated by a magnetizing field, the other is operated by a demagnetizing field.

6 Claims, 13 Drawing Figures

MEANS FOR THE DEACTIVATION OF ELECTRIC BLASTING CAPS

STATEMENT OF GOVERNMENT INTEREST

The invention described herein was made by an employee of the U.S. Government and may be manufactured and used by or for the Government for governmental purposes without the payment of any royalties thereon or therefor.

BACKGROUND

The present case is a continuation in part of application Ser. No. 947,974 filed Oct. 2, 1978, now abandoned.

At the present time and into the foreseeable future, there is a continuing threat of explosive sabotage to public and private facilities. In the past, efforts to counter this threat have been directed at controlling the distribution and availability of explosives, "tagging" the explosives so as to permit post-explosion identification of the source of the explosives as an aid in apprehending the perpetrator, and the detection of bombs by the constituents of the explosives and/or other components (blasting caps, etc.) of a bomb, either normal constituents or those specifically added during manufacture to facilitate detection. Detection typically is envisioned as taking place during screening of articles as they pass in or out of protected areas by means of specially designed apparatus.

It is the purpose of this invention to prevent bombings by disabling the electrically fired blasting caps which are used to initiate the explosives in the vast majority of terrorist bombs. The disabling would take place by means of a special device introduced into all blasting caps during their manufacture. The device must not reduce the reliability of the blasting cap in normal use and, when once activated, must irreversibly disable the blasting cap to preclude a terrorist bomb from exploding.

In general, the terrorist bomb containing the blasting cap will be disguised and the cap not visible to casual observation. The means of disabling the blasting cap must therefore have the ability to penetrate the bomb container and the shell of the blasting cap itself so as to operate the disabling device introduced during manufacture. This will limit the possible means of disabling to penetrating radiation such as x-rays, gamma radiation, neutrons, acoustics and magnetic fields. Electric fields are too easily shielded by conducting materials which may surround the blasting cap, frequently the shell of the cap itself. Sonic or acoustic fields may be too greatly attenuated by the materials surrounding the bomb. The quantity of ionizing radiation which can be used is limited by safety considerations to somewhere in the order of 1 to 10 ergs deposited per gram of material. Moreover, any device whose response to the ionizing radiation will deactivate the blasting cap must not respond to an accumulation of background radiation energy over a period of years. Magnetic fields, the approach used in the present invention, avoid the problems created by the other types of radiation.

Accordingly, it is an object of the present invention to provide a blasting cap that can be rendered permanently disabled.

It is a further object of the present invention to provide such a blasting cap wherein the means to render it disabled is a magnetic field.

It is a further object of the present invention to provide such a blasting cap wherein application of the magnetic field causes a permanent disruption of the normal electrical circuit of the blasting cap.

SUMMARY

Briefly, the present invention is an electric blasting cap having a magnetic switch in it. The switch is a normally closed latched open switch, which creates an open circuit in the electrical circuit of the cap on application of the magnetic field, or a normally open latched closed switch, which creates a short circuit in the cap. Either switch remains in its latched position after the magnetic field is removed, thereby rendering the blasting cap disabled.

DESCRIPTION OF THE PREFERRED EMBODIMENTS

Figure 1:
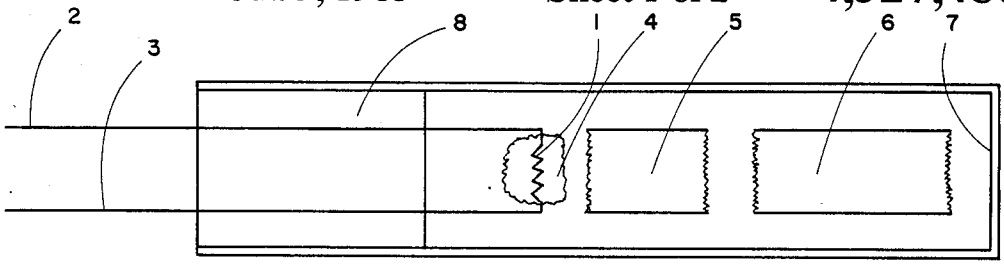
FIG. 1 shows a prior art blasting cap.

FIG. 1 shows diagramatically a typical prior art electrically detonated blasting cap. Bridge wire 1, when heated by electrical energy supplied through leads 2 and 3, ignites a thermally sensitive compound 4 which in turn ignites a delay charge 5, which in turn ignites a booster charge 6, which produces the blast front to detonate the high explosive charge. Shell 7 is typically metal, copper or aluminum, and the water proof plug 8 is a plastic or rubber compound.

Figure 2A:
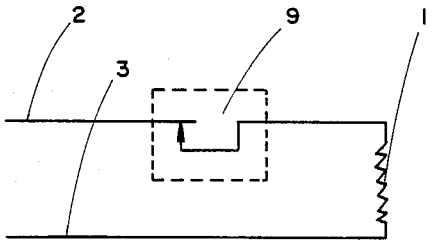
FIGS. 2*a* and 2*b* are schematics of two types of electric circuits that can be disabled by the application of magnetic fields.
Figure 2B:
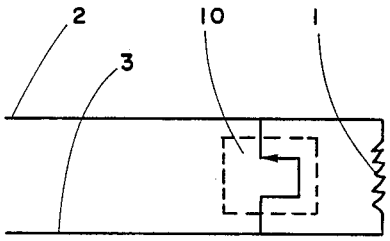

Disabling of the blasting cap can best be achieved by preventing electrical energy from reaching bridge wire 1 via leads 2 and 3. FIGS. 2*a* and 2*b* show schematically two general techniques for achieving disabling. Item 9 in FIG. 2*a* is a normally closed switch in series with bridge wire 1. Prior to disabling, switch 9 can pass electrical energy in the normal fashion from leads 2 and 3 to bridge wire 1 and the blasting cap can function in a normal manner. Bridge wire 1 and leads 2 and 3 thus constitute a normally continuous electric circuit which is capable of detonating the blasting cap upon the passing of electric energy through leads 2 and 3. Upon imposition of the magnetic field, switch 9 goes from normally closed to irreversibly open, interrupting the current path to bridge wire 1 and effectively disabling the blasting cap. The present blasting cap is therefore the opposite of the type shown in U.S. Pat. Nos. 2,889,776; 3,658,009; 3,075,461; 2,918,001; and 3,585,933. In these patents the device is in a condition that renders it inoperative unless and until a first operation is performed to put it in condition for firing; for example, in U.S. Pat. No. 2,918,001 the device cannot be fired until current is passed through coil 15 to activate solenoid 31 which upon activation bridges contacts 21 and 23, thereby completing the firing circuit. In a similar manner, switch 10, FIG. 2*b* of the present invention is a normally open switch placed across bridge wire 1. When irreversibly closed by means of the magnetic field, it short circuits bridge wire 1 preventing electrical energy from leads 2 and 3 from heating bridge wire 1, which thereby disables the blasting cap. Switch 9 is obviously a nonexplosive device, since it does not depend on any explosions for its operation.

Figure 3:
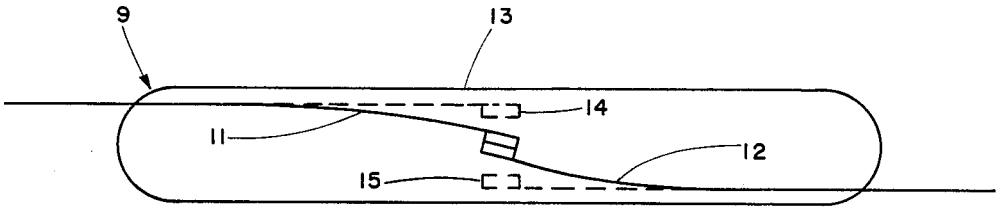
FIG. 3 shows the operation of a switch that forms an open circuit in the blasting cap on the application of a damagnetizing field.

One, but by no means the only, way to realize the normally closed, irreversibly open (open circuit) switch 9 of FIG. 2*a* is through the use of a magnetic reed switch shown in greater detail in FIG. 3. This switch consists of a non-conducting housing 13 holding ferromagnetic reeds 11 and 12 in the dashed line position. Contacts 14 and 15 mounted on the ends of reeds 11 and 12 serve to provide a low resistance path between these reeds when they are in intimate contact. The ferromagnetic reeds are positioned in housing 13 so that they would ordinarily be separated and contacts 14 and 15 would not touch. During manufacture, ferromagnetic reeds 11 and 12 and contacts 14 and 15 are magnetized so as to form bar magnets with polarities such that contacts 14 and 15 are of opposite magnetic polarity (North-South or South-North), attract each other, and close the electrical circuit between reeds 11 and 12 as shown in the solid lines. To operate switch 9, that is to disable the blasting cap, the switch is exposed to a demagnetizing magnetic field (a magnetic field of alternating polarity which is relatively slowly reduced in amplitude to zero). The demagnetized reeds then spring apart and open the circuit as shown in the dashed lines. To facilitate the demagnetization of reeds 11 and 12, they should be fabricated of magnetically soft material; that is, material which can be magnetized and demagnetized easily. In the contemplated application, all articles to be screened would be passed through a demagnetizing field. Should a bomb with an electrically fired blasting cap having such a switch be present, switch 9 would be demagnetized, opening the circuit to bridge wire 1 and safely deactivating the bomb.

Figure 4:
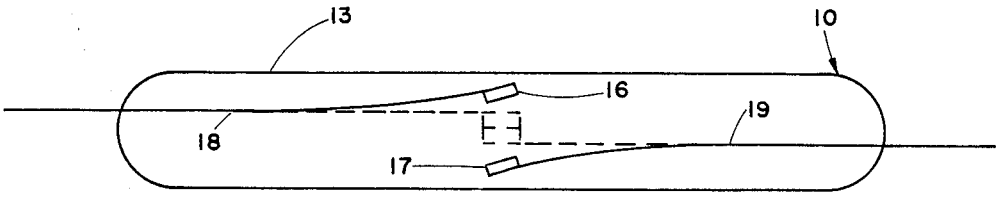
FIG. 4 shows the operation of a switch that forms a short circuit in the blasting cap on the application of a demagnetizing field.

In a similar manner, switch 10 of FIG. 2*b* would be fabricated as shown in FIG. 4 so that contacts 16 and 17 carried by reeds 18 and 19 are in contact (dashed lines) when the switch is demagnetized. During manufacture, reeds 18 and 19 and contacts 16 and 17 would be magnetized so that contacts 16 and 17 are at similar magnetic poles of the magnetized reeds (North-North or South-South). Since like magnetic poles repel, the magnetic field would keep these contacts apart, as shown in the solid lines in FIG. 4. During screening, the demagnetizing field would demagnetize reeds 18 and 19 permitting the spring tension to close contacts 16 and 17 as shown the dashed lines and disable the blasting cap.

Figure 5:
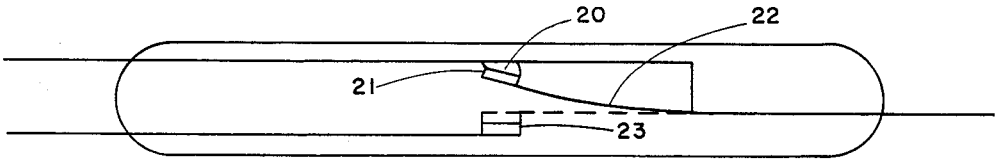
FIG. 5 shows a switch that forms both a short circuit and an open circuit in the blasting cap on the application of demagnetizing field.

A more reliable configuration is shown in FIG. 5; this is a combination of the configurations described above. Contacts 20 and 21 are of opposite polarity, hence are attracted to each other and form a complete firing circuit. When reed 22 is demagnetized, contact 21 assumes the dotted line position and touches contact 23. This produces an open circuit at a first point between contacts 20 and 21 and a short circuit at a second point between contacts 21 and 23, both of which prevent current from reaching bridge wire 1. Whereas in the preceding configurations it may be possible to overwhelm the circuit interruption by supplying excessive amounts of energy which either jump the open circuit or leak past the short circuit, this configuration offers substantially greater resistance to such an attempt.

Figure 6:
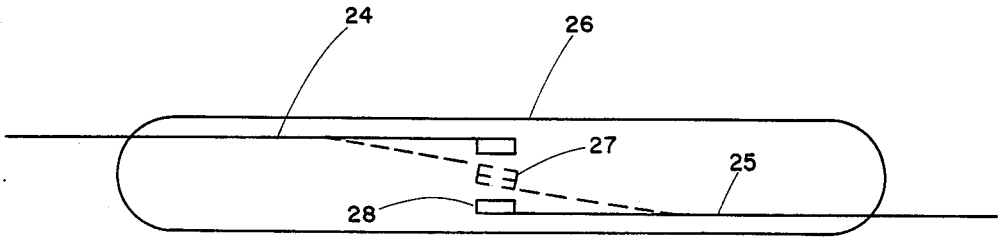
FIGS. 6 and 7 show switches that disable a blasting cap by the application of a magnetizing field.

Alternatively, the disabling switch could be designed to function when a magnetizing field is applied. Such a switch that forms a short circuit is shown in FIG. 6. Reeds 24 and 25 are formed of magnetically hard material and mounted in housing 26 as shown in the solid lines so that contacts 27 and 28 do not touch. When placed in a strong magnetic field reeds 24 and 25 will become magnetized, attract each other, and form a short circuit as shown schematically in FIG. 2*b*.

Figure 7:
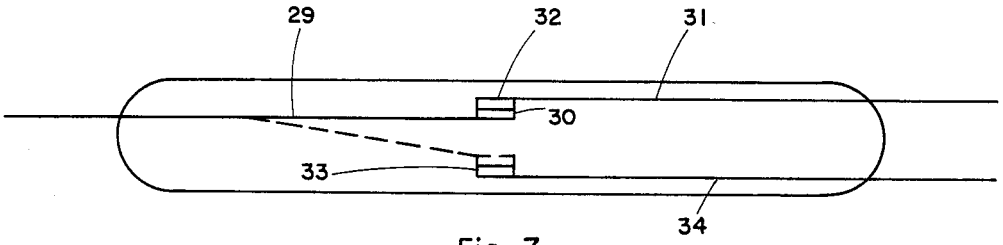

A switch that forms an open circuit upon application of a magnetic field is shown in FIG. 7. In this configuration reed 29 and contact 30 are formed of magnetically hard material while reed 31 and contact 32 are formed of nonmagnetic material. Contact 33 is formed of magnetically hard material, but is not connected to the electrical circuit of the blasting cap. When placed in a strong magnetic field reed 29, contact 30, and contact 33 become magnetized and contact 30 is attracted to contact 33 as shown in the dashed line; this opens the circuit between contacts 30 and 32 and disables the blasting cap. If desired, wire 34 can be attached to contact 33 to form a short circuit across the bridge wire when contact 30 touches contact 33; this produces a switch having both a short circuit and an open circuit as described above.

Figure 8:
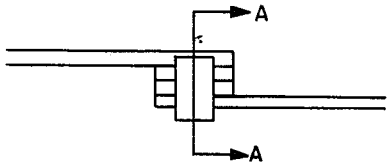
FIGS. 8, 9*a*, 9*b*, 10*a*, and 10*b* show latches that keep the switches in their disabling positions.
Figure 9A:
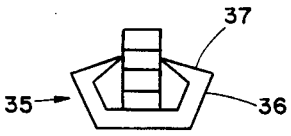
Figure 9B:
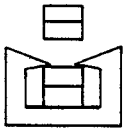

In order to prevent the contacts from returning to their original position after the cap has been disabled, it may be desirable to incorporate latches that keep the contacts in their disabling position FIG. 8 shows the placement of the latch with respect to the contacts. FIG. 9*a*, taken on line A—A of FIG. 8, shows a latch 35 that is designed to keep normally closed contacts open after the application of the magnetic field. Arms 36 are spring biased toward each other; when the contacts separate under the influence of the magnetic field projections 37 on arms 36 are inserted in the gap as shown in FIG. 9*b* and the contacts are prevented from touching.

Figure 10A:
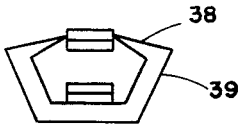
Figure 10B:
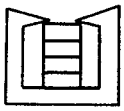

FIGS. 10*a* and 10*b*, also taken on line A—A of FIG. 8, show a latched designed to maintain a short circuit after the application of a magnetic field. In this application projections 38 on arms 39 (which are also spring biased toward each other) envelop the movable contact after application of magnetic field; the taper on projections 38 helps to keep the two contacts together. It should be noted that in both cases the latch is attached to the stationary contact, and that the ends of projections 37 and 38 are rounded so that the movable contact can move freely.

Examples of magnetically "soft" materials that are suitable for use in the present invention are iron, 4% silicon iron, and cold rolled steel; magnetically "hard" materials are carbon steel, tungsten steel, and 37% cobalt steel.

What is claimed is:

1. A blasting cap comprising: an explosive charge; electrical ignition means to ignite said explosive charge, said ignition means comprising a normally continuous electric circuit; and nonexplosive means within said electrical ignition means to permanently disable said ignition means, said means to permanently disable said ignition means comprising a magnetic reed switch.

2. A blasting cap as in claim 1 wherein said magnetic reed switch moves to its disabling position upon the application of an external magnetizing field.

3. A blasting cap as in claim 1 wherein said magnetic reed switch moves to its disabling position upon the application of an external demagnetizing field.

4. A blasting cap as in claim 1 wherein said magnetic reed switch creates an open circuit within said electrical ignition means when said magnetic switch is in its disabling position.

5. A blasting cap as in claim 1 wherein said magnetic reed switch creates a short circuit within said ignition means when said magnetic switch is in its disabling position.

6. A blasting cap as in claim 1 wherein said magnetic switch creates both a short circuit at a first point and an open circuit at a second point within said ignition means when said magnetic reed switch is in its disabling position.

* * * * *